US007419127B2

(12) United States Patent
Buehler

(10) Patent No.: US 7,419,127 B2
(45) Date of Patent: Sep. 2, 2008

(54) SWIVEL ARM ASSEMBLY FOR PLUMBING FIXTURES

(75) Inventor: Juergen Buehler, Schiltach (DE)

(73) Assignee: Hansgrohe AG, Schiltach (DE)

( * ) Notice: Subject to any disclaimer, the term of this patent is extended or adjusted under 35 U.S.C. 154(b) by 4 days.

(21) Appl. No.: 10/538,553

(22) PCT Filed: Nov. 20, 2003

(86) PCT No.: PCT/EP03/12981

§ 371 (c)(1),
(2), (4) Date: Jun. 13, 2005

(87) PCT Pub. No.: WO2004/055278

PCT Pub. Date: Jul. 1, 2004

(65) Prior Publication Data

US 2006/0180721 A1 Aug. 17, 2006

(30) Foreign Application Priority Data

Dec. 13, 2002 (DE) ..... 102 60 204

(51) Int. Cl.
*E04G 3/00* (2006.01)

(52) U.S. Cl. ..... 248/292.12; 248/292.13; 403/105; 403/93

(58) Field of Classification Search ..... 248/288.11, 248/289.11, 291.1, 292.12, 289.31, 292.11, 248/292.13; 403/101, 103–105, 150, 157, 403/93, 96, 370, 314, 374.4, 374.3
See application file for complete search history.

(56) References Cited

U.S. PATENT DOCUMENTS 3,018 A * 3/1843 Webb ..... 403/105
469,158 A * 2/1892 Manley ..... 211/69.2
473,919 A * 5/1892 Edsall ..... 248/292.12
577,429 A * 2/1897 Homan ..... 248/230.4
869,973 A * 11/1907 Lehmkuhl ..... 248/292.11
900,475 A * 10/1908 Bradstock ..... 248/257
1,003,037 A * 9/1911 Crowe ..... 74/128
1,053,658 A * 2/1913 Sinclair ..... 160/300
1,059,217 A * 4/1913 Rudy ..... 248/279.1
1,099,360 A * 6/1914 Harris ..... 160/300
1,896,505 A * 2/1933 Bartholomew ..... 57/89
2,395,178 A * 2/1946 Fiori ..... 248/597
3,304,107 A * 2/1967 Bahmuller ..... 403/93
3,484,795 A * 12/1969 Nicolay ..... 15/144.4
3,484,831 A * 12/1969 Higuchi ..... 403/103
3,659,807 A * 5/1972 Fleischer ..... 242/268

(Continued)

FOREIGN PATENT DOCUMENTS

CH 691 656 A5 9/2001

(Continued)

*Primary Examiner*—Ramon O. Ramirez
*Assistant Examiner*—Michael McDuffie
(74) *Attorney, Agent, or Firm*—Duane Morris LLP

(57) ABSTRACT

An articulated-arm arrangement for plumbing fixtures, for example, a shower head, contains a mounting fixture that may be fastened to a wall. A pivot joint for a wall-mounting arm that may be pivoted about a horizontal axis is accommodated within the mounting fixture. The pivot joint contains a brake for locking the wall-mounting arm in place and a slip-clutch in order to allow pivoting the wall-mounting arm upwards, against the action of its own weight, without releasing the brake from its braking setting.

16 Claims, 3 Drawing Sheets

U.S. PATENT DOCUMENTS

| | | | | | |
|---|---|---|---|---|---|
| 3,693,469 | A | | 9/1972 | Ozaki | |
| 4,034,946 | A | * | 7/1977 | Zimmer, Jr. | 248/183.2 |
| 4,041,798 | A | * | 8/1977 | Shinozaki et al. | 74/512 |
| 4,077,582 | A | * | 3/1978 | Way | 242/256 |
| 4,130,028 | A | * | 12/1978 | Solberg | 74/577 R |
| 4,139,245 | A | * | 2/1979 | McCloskey | 384/203 |
| 4,174,822 | A | * | 11/1979 | Larsson | 248/75 |
| 4,948,083 | A | * | 8/1990 | McNaney et al. | 248/514 |
| 5,027,930 | A | * | 7/1991 | Reed | 192/217.2 |
| 5,117,948 | A | * | 6/1992 | Yoshigai | 188/24.19 |
| 5,129,698 | A | * | 7/1992 | Cohrs et al. | 296/98 |
| 5,201,236 | A | * | 4/1993 | Nagano | 74/388 R |
| 5,273,500 | A | * | 12/1993 | Nagano | 475/312 |
| 5,458,647 | A | * | 10/1995 | Brochier et al. | 623/21.17 |
| 5,582,379 | A | * | 12/1996 | Keselman et al. | 248/279.1 |
| 5,690,317 | A | * | 11/1997 | Sandsborg | 256/1 |
| 5,802,755 | A | * | 9/1998 | Tortorici et al. | 42/75.02 |
| 5,833,192 | A | * | 11/1998 | Buhrman | 248/295.11 |
| 6,024,331 | A | | 2/2000 | Bischoff et al. | |
| 6,123,308 | A | | 9/2000 | Faisst | |
| 6,179,093 | B1 | * | 1/2001 | Daugherty, Jr. | 188/33 |
| 6,268,556 | B1 | * | 7/2001 | Liao | 84/421 |
| 6,473,916 | B2 | * | 11/2002 | Schi.o slashed.dt | 4/567 |
| 6,502,796 | B1 | * | 1/2003 | Wales | 248/316.1 |

FOREIGN PATENT DOCUMENTS

| | | | |
|---|---|---|---|
| DE | 44 30 805 | A1 | 5/1995 |
| DE | 198 02 917 | A1 | 5/1999 |
| EP | 0 790 358 | A2 | 8/1997 |
| GB | 2 192 530 | A | 1/1988 |

* cited by examiner

SWIVEL ARM ASSEMBLY FOR PLUMBING FIXTURES

BACKGROUND OF THE INVENTION

The invention is based on a wall-mounting arm for a plumbing fixture, for example, a shower head. Mounting shower-head supports at fixed locations is known, as is, for example, employing wall-mounting arms that may be pivoted about a horizontal axis in order to adjust them to suit users of varying heights. The arm should remain stationary once it has been adjusted to suit users of a certain height, i.e., has been set to a corresponding pivot angle. Both manually actuated locking devices and friction brakes that may be adjusted such that the wall-mounting arm will remain stationary, even when called upon to support the weight of the shower head, are available for that purpose. Friction brakes wear, which leads to changes in their braking actions in the course of time. That problem may be aggravated by entry of water or soap into the braking device, which will also affect its braking action.

Adjustable wall-mounting arms should, of course, be readily adjustable. In the case of larger, or heavier, shower heads, as well as longer wall-mounting arms, however, a detenting brake will have to be set such that it counteracts the weight of the shower head, plus that of the shower hose attached thereto. Although wall-mounting arms of that type may be very easily adjusted downward if their brake has been accurately set, adjusting them upward requires considerable physical effort, since the weight of both the shower head and the hose have to be raised and the braking force has to be overcome.

A device for holding a shower head having a brake, where a multidisk disk brake is employed, is already known (cf. World Patent WO 02/44482). The axle, about which the wall-mounted arm is pivoted, is permanently fastened to the console.

SUMMARY OF THE INVENTION

Among the challenges addressed by the invention is creating an articulated-arm assembly for plumbing fixtures that is user-friendly and guarantees smooth operation over an extended time period.

In order to solve that problem, the invention proposes an articulated-arm assembly having those features disclosed and claimed herein.

The invention is intended for use with arbitrary types of plumbing fixtures where the aforementioned problem occurs. In particular, it should, of course, serve as a support for a shower head, since, in that case, the problems of the greater weight and longer wall-mounting arm appear particularly important. However, it may also be used for supporting, for example, cosmetic mirrors or holders.

Due to the employment of a ratchet, as proposed by the invention, only the weight of the shower head will have to be overcome when making upward adjustments, since, in that case, the brake need not be overcome. When adjusting it downward, only the greater starting friction will need to be overcome initially, while, in the case of subsequent adjustments, only the sliding friction of the adjustment motion will counteract.

Since the opposed brake elements move in unison during upward adjustments (only), wearing of the brake will be greatly reduced. Moreover, the brake acts in one direction only, i.e., does not generate drag in both directions, which means that the braking surfaces will, nevertheless, be progressively brought into play over their full circumference, even if the angular readjustment of the arm is slight, in order that no localized wearing will take place, which will also lead to an extension of the braking device's service life.

In elaborating on the invention, it may be provided that the brake and/or the ratchet are part of the pivot joint for the arm. That pivot joint may, preferably, be arranged in, and accommodated in, the assembly's mounting fixture in order that the pivot joint will be covered and shielded from the ambient.

Since the articulated-arm assembly is suitable for use with more than just shower heads, its pivot axis may be arbitrarily arranged, since there are cases where adjustment should be easier in one direction than in the other, even in the case of vertical pivot axes. In particular, however, the pivot axis should, of course, be horizontal.

In elaborating on the invention, it may be provided that the ratchet acts on a sleeve or collar that may be joined to, or is joined to, the arm, in particular acts on the outer surface of the sleeve or collar. Since a pivot must invariably have a certain axial length, an extended surface area that the ratchet, or the ratchet's pawl, may engage will thus be available.

In particular, it may be provided that the ratchet's pawl is arranged on the mounting fixture and has a length equaling that of the ratchet's collar. In the case of the pawl, wearing will generally be much less, since no braking is to occur there, which means that by choosing suitable combinations of materials or lubrication, it may be provided that no wearing occurs there.

According to the invention, the brake, which may comprise several components, may be fastened to the arm such that it is constrained from rotating with respect to the arm.

The joint joining the arm and the ratchet's collar may, preferably, be created by the brake, in which case, the ratchet's collar will co-rotate with the arm, provided that the brake is not overcome.

According to the invention, it may be provided that the brake is a friction brake. Friction brakes of that type act with high efficiencies both during gliding and while the items braked are stationary, which means that that type of brake will be appropriate.

In particular, it may be provided that the brake engages a cylindrical inner surface of the ratchet's collar, in which case, the available space will also be optimally utilized. The greater the radius of those locations on which the brake acts during rotation, the more effective its braking action will be.

In particular, the brake may, of course, be arranged coaxial with the ratchet, i.e., be arranged within the ratchet's sleeve or collar.

In elaborating on the invention, it may be provided that the brake contains several brake shoes having at least one radial braking motion, where the brake shoes may, for example, be actuated by at least one conical component that may be translated in an axial direction. Employment of a conical component will allow an extremely fine presetting of the braking force, and thus extremely fine adjustment of the braking torque, at which the brake will be overcome, by choosing its vertex angle. The tilt of the wall-mounting arm may also be so finely readjusted in the downward direction, that is, in the direction for which the ratchet is inoperative, that its readjustment requires very little physical effort.

In particular, it may be provided that a pair of counteroriented, conical components whose separation is adjustable are arranged within the brake, which will also allow obtaining very even contacting by the brake shoes in order that wearing due to sliding friction will be uniformly distributed.

In order to obtain an even better opportunity for compensating for maladjustments of the brake, it may be provided that the pair of conical components jointly have axial play, i.e., are freely suspended within the braking device.

According to the invention, the brake may be spring-loaded.

In further elaborating on the invention, it is provided that the space accommodating the brake and/or ratchet is configured such that it is sealed with respect to the ambient, where here sealing against the effects of liquids plays a major role, and sealing out dust and other dry contaminants will also be sensible.

BRIEF DESCRIPTION OF THE DRAWINGS

Other features, details, and benefits of the invention will be evident from the claims and the abstract, both of whose wordings are herewith made part of this description by way of reference thereto, the following description of preferred embodiments of the invention, and the drawings, which depict:

DETAILED DESCRIPTION

Figure 1:
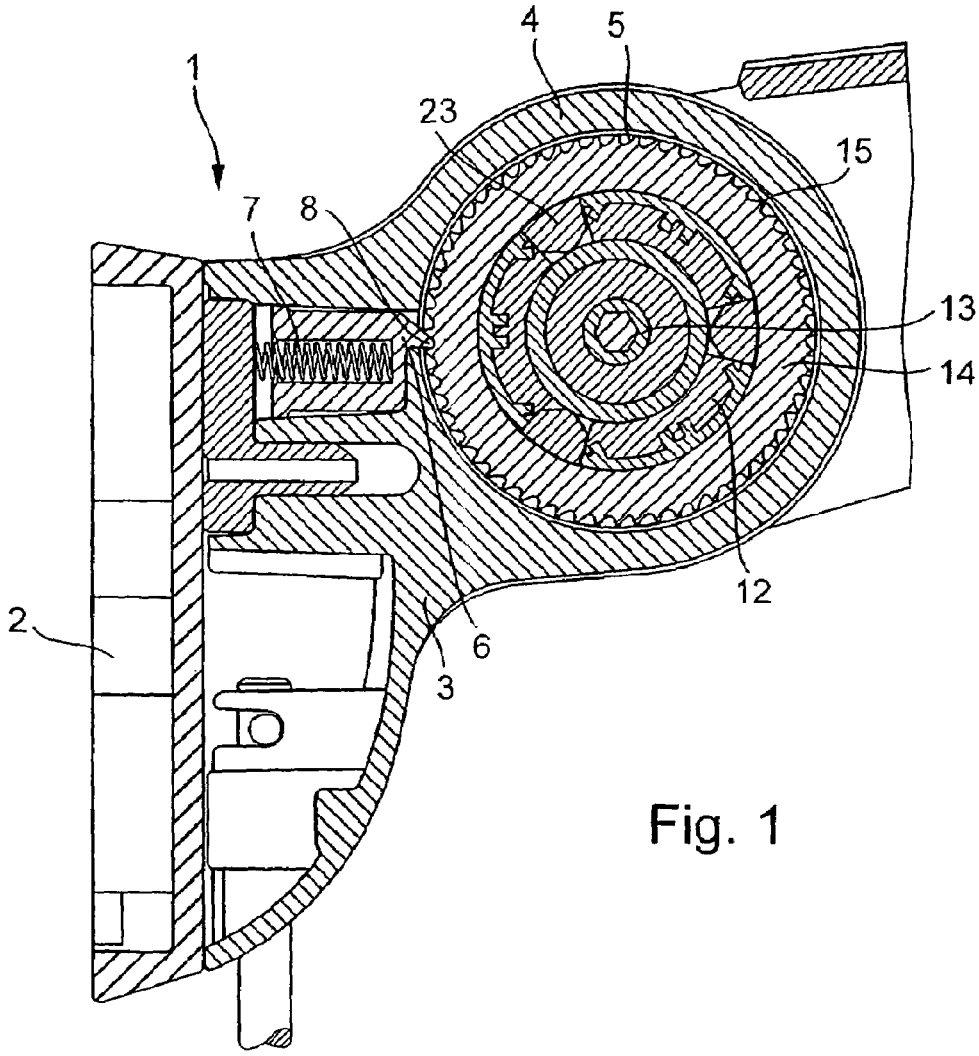
FIG. 1 a vertically sectioned view of an articulated-arm assembly.
Figure 2:
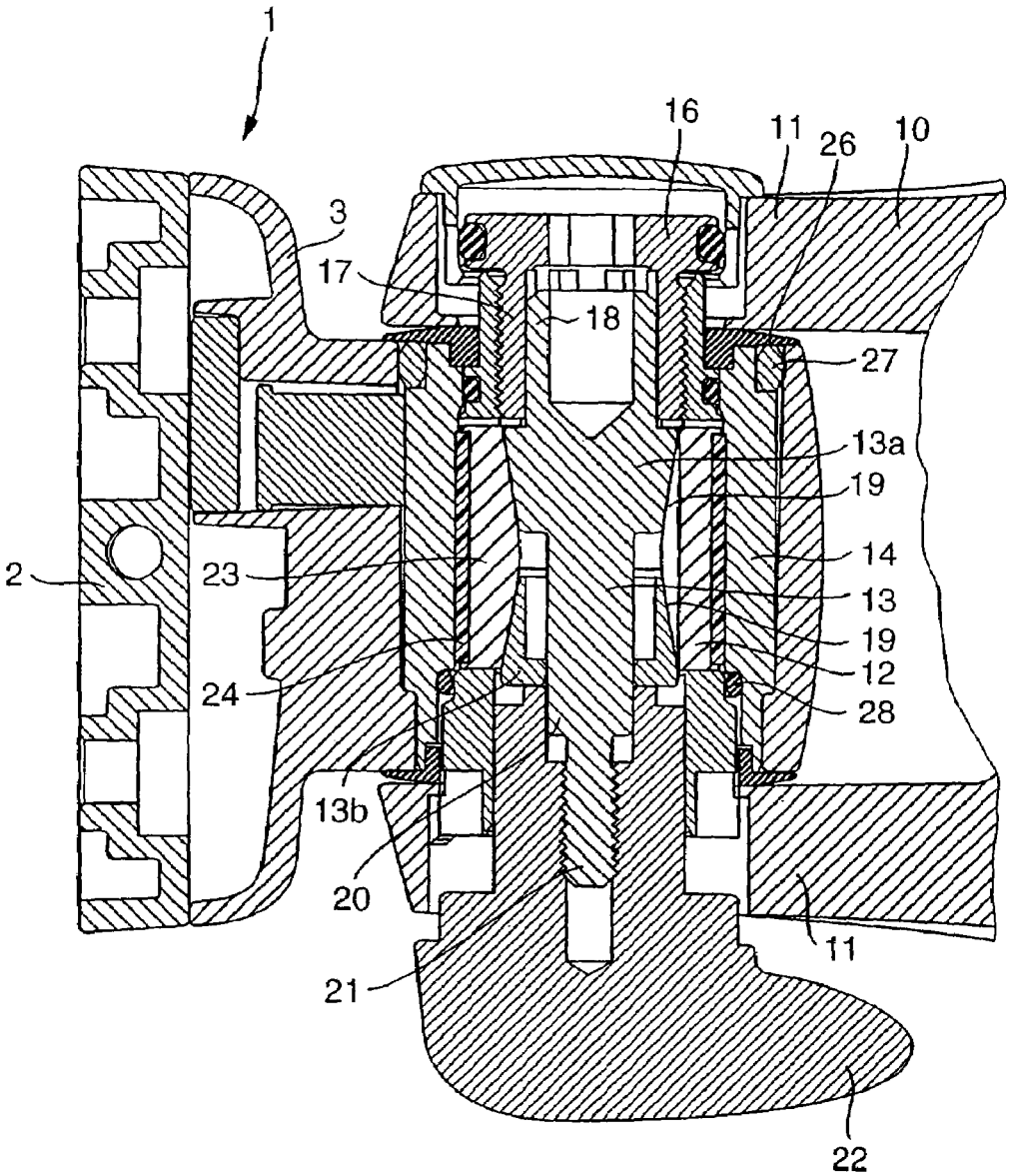
FIG. 2 a horizontally sectioned view of the assembly shown in FIG. 1.

In FIGS. 1 and 2, the mounting fixture 1, with which the articulated-arm assembly may be fastened to a vertical surface, for example, a wall of a room, is visible at left. The mounting fixture 1 contains a base 2, from which the remaining components thereof may be removed. The base 2 has through holes, through which screws may be inserted in order to, as a first step, fasten the base 2 in place. The second component 3 may then be fastened thereto. That component 3 contains a protrusion 4 that is configured in the form of a cylindrical collar. A receptacle in the form of a circular cylinder is formed in the interior 5 of that protrusion. Within that receptable in the form of a circular cylinder, a pawl 6 that is preloaded by a spring 7 juts out of the side of the base. A tooth 8 on the pawl 6, which may be slid back, approximately radially outward with respect to the axis of the interior 5 of the protrusion, extends into the interior of the protrusion.

The wall-mounting arm 10 is forked in the vicinity of that end thereof that faces the mounting fixture 1 in order that it will form a pair of tines 11 separated by a gap. A braking device 12 that is fastened to the arm 10 such that it is constrained from rotating with respect to the latter when it is rotated about the axis of the interior 5 of the protrusion is inserted between the pair of tines 11. The braking device 12 is configured similar to a cage and, as has been mentioned earlier, engages the tips of the tines 11 of the wall-mounting arm 10 such that they will be constrained from rotating, in the vicinities of its lateral ends. The braking device 12 contains a core 13 (cf. also FIG. 2) situated within its interior, which is open and clear over its full length. That core 13 has a certain amount of axial play within the interior of the braking device 12. That axial play is obtained by providing that a cap 16 that has a longitudinal profiling within a hollow 17 extension is screwed into the upper, in FIG. 2, end of the braking device 12. The associated end 18 of the core engages that longitudinal profiling.

Outside the braking device 12, a collar 14 is arranged in the receptacle 5 of the protrusion 4 on the mounting fixture 1, and is thus coaxially arranged between the braking device 12 and the protrusion 4 on the mounting fixture 1. That collar 14 has a longitudinal profiling 15 in the form of shapes resembling sawteeth (cf. the sectioned view appearing in FIG. 1, where that profiling is clearly visible). The shape of that profiling 15 resembling sawteeth on the exterior of the collar 14 matches that of the sawtooth 8 on the pawl 6. The orientation thereof is chosen such that the pawl 6 will be forced back, against the preloading exerted by the spring 7, when the collar 14 is rotated counterclockwise, in FIG. 1, in order that rotation of the latter will not be hindered. Counterclockwise rotation in FIG. 1 corresponds to raising the wall-mounting arm 10.

The core 13 is configured in two parts. That portion of the core 13 whose extension 18 engages the cap 16 such that it constrains rotation of the latter with respect to the core contains a conical outer surface 19 adjoining the extension 18 that extends approximately to the center of the core 13, and is adjoined by a shaft 20 that merges with a threaded extension 21, intermediated by a shoulder. A second part 13*b* that also has a conical surface 19 that is oriented opposite to the first conical surface 19 formed on its exterior is set onto the shaft. The maximum diameters of the pair of conical surfaces 19 occur at the opposed ends of the associated parts of the core 13.

Part 13*b* of the core is axially translatable along the shaft 20. Its axial translation is accomplished by screwing an adjustment knob 22, whose far end abuts against that part 13*b* of the core, onto the threaded extension 21. The farther the adjustment knob 22 is screwed onto the threaded extension 21, the farther that part 13*b* of the core will be shifted toward the first part 13*a* of the core in order to shorten the gap between the pair of conical surfaces 19.

That the braking device is configured similar to a cage has been mentioned earlier. In that conjunction, reference is, once again, made to FIG. 1. The braking, device has three slots, in which brake shoes 23 that extend along the axial direction and may be slid along the radial direction are arranged, distributed over its surface. The brake shoes 23 have a brake lining 24 on their outer circumference, and shallow, pent-roof-shaped structures, whose two flat surfaces abut against the respective, associated, conical surfaces on the two parts 13*a*, 13*b* of the core, formed in the vicinity of their inner circumference. Translating the two parts 13*a*, 13*b* of the core relative to one another will thus cause the brake shoes 23 to move further outward, i.e., force them up against the inner surface of the collar 14, as will be evident from FIG. 1, and is indicated on the left side of the braking device in FIG. 2. Translating the two parts 13*a*, 13*b* of the core relative to one another will compensate for the changes in their absolute positions, due to the fact that part 13*a* of the core has axial play.

The positioning of the parts 13*a*, 13*b* of the core relative to one another thus determines the force that the braking device exerts on the inner surface of the collar 14 via the brake shoes 23.

The mode of operation of the assembly that has been described is as follows: The braking device is fastened to the wall-mounting arm 10 that it is to brake or hold in place such that it is constrained from rotating with respect to the latter. Screwing the adjustment knob 22 into the braking device 12 adjusts the brake such that the ratchet's collar 14 will also be joined to the wall-mounting arm 10 such that will be constrained from rotating with respect to the latter. The joint joining the wall-mounting arm 10 and the ratchet's collar 14 will continue to be such that the latter is constrained from rotating with respect to the former until such time as a force sufficient to overcome the brake's braking action is exerted on the wall-mounting arm.

If the wall-mounting arm 10 takes up, for example, the position shown in FIG. 1, then the brake will hold the arm in place relative to the ratchet's collar 14, which is constrained from rotating due to its being engaged by the pawl 6. The arm will thus remain stationary. If the shower head attached to the far end of the arm, which has not been shown, is to be lowered, the user grasps the arm and pivots it downward, thereby exerting a torque exceeding the restraining force that the brake is capable of exerting. The brake will commence to slip. The arm will remain stationary once again as soon as the user releases it.

However, if the user wants to raise the shower head, he lifts the arm 10. Due to the brake, a torque will, once again, be exerted on the ratchet's collar 14, which, since the contouring of its longitudinal profiling 15 is as shown, will then slide the pawl 6 back and co-rotate with the arm. The friction-bond between the braking device 12 and the ratchet's collar 14 will thus remain effective.

Friction, and thus wearing of the brake, hence do not occur when the arm is pivoted in both directions. The braking device shown in FIG. 1 invariably rotates clockwise with respect to ratchet's collar 14, which is held stationary. The braking device and its brake shoes thus invariably rotate in one direction only relative to the ratchet's collar 14, whose inner surface forms the surface on which the brake acts.

The protrusion 4 on the mounting fixture 1, which accommodates the braking device and ratchet within its interior and protects them, is closed off by bezels 26, one on each lateral end thereof, where the bezels 26 may be provided with seals 27, if deemed necessary. Due to these various measures, that interior, within which the braking device and ratchet are situated, is sealed with respect to the ambient. Further seals 28 (cf. FIG. 2) seal the braking device.

Figure 3:
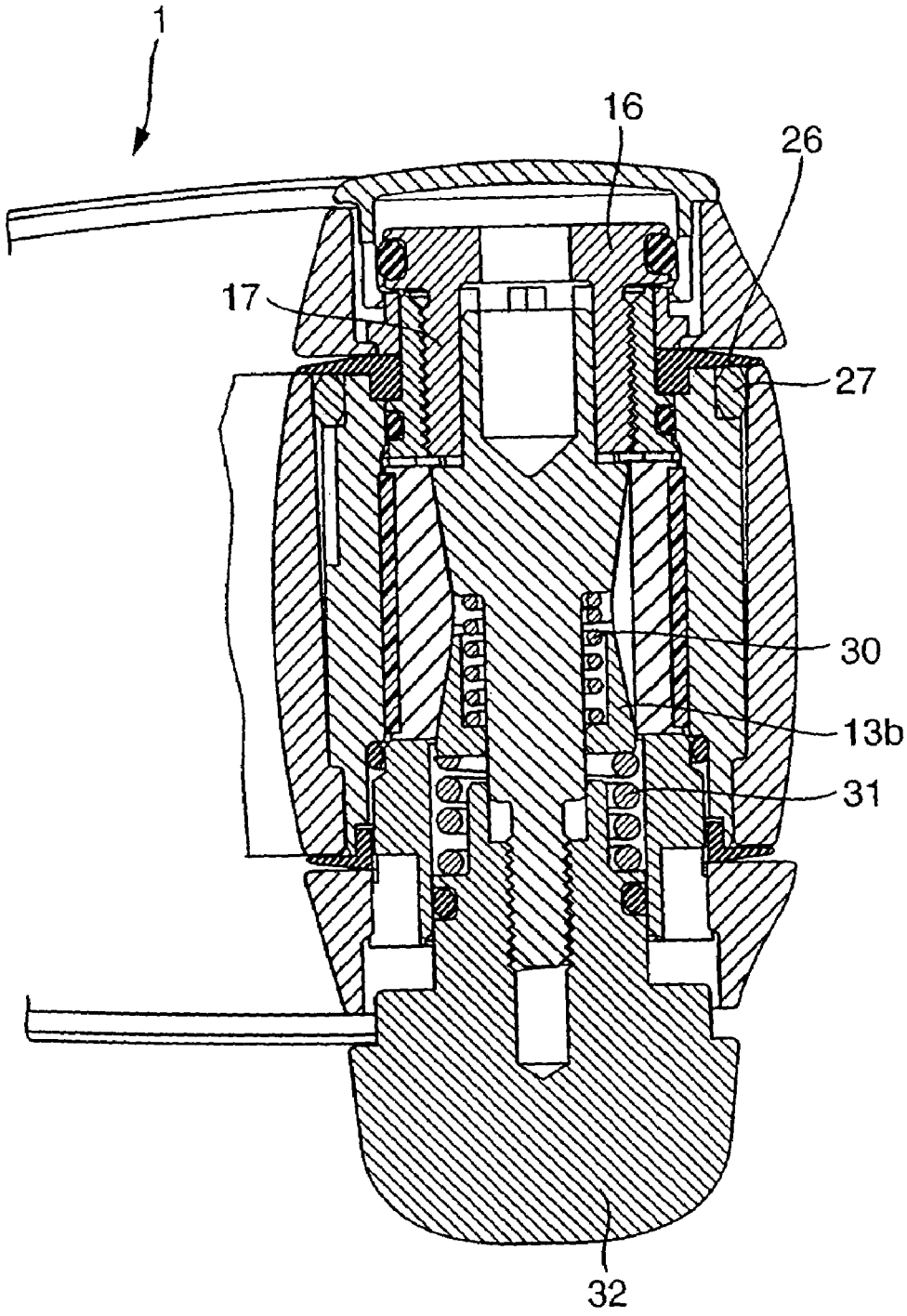
FIG. 3 a sectioned view, corresponding to that of FIG. 2, of a modified embodiment.

Whereas, in the case of the embodiment shown in FIGS. 1 and 2, the adjustment knob 22 acts directly on one of the pair of conical components in order to adjust the braking force, in the case of the embodiment shown in FIG. 3, a helical compression spring 31 is inserted between the adjustment knob 32 and one part 13*b* of the core. That helical compression spring 31 effects a preloading of the brake, causing it to exert a braking force.

The second spring 30 shown serves to force the pair of components 13*a*, 13*b* forming the core apart in order that a reduction in the preset braking force will be possible, without encountering difficulties.

What is claimed is:

1. An articulated-arm assembly for plumbing fixtures, comprising:

a mounting fixture for fastening the assembly in place, an arm jutting out of the mounting fixture, a pivot joint for joining the arm to the mounting fixture, a normally engaged brake for locking the arm in place, and a ratchet that allows pivoting of the arm in one direction while the brake is engaged;

wherein the ratchet acts on a sleeve or collar while joined relative to the arm, wherein the ratchet has a pawl arranged on the mounting fixture and wherein the pawl has a length equaling that of the sleeve or collar; and, wherein by disengaging the brake the arm can be pivoted without unlocking the ratchet.

2. An articulated-arm assembly according to claim 1, wherein at least one of the brake and the ratchet are part of the pivot joint for the arm.

3. An articulated-arm assembly according to claim 1, wherein a pivot axis of the pivot joint is horizontal.

4. An articulated-arm assembly according to claim 1, wherein the brake is fastened to the arm such that the brake is constrained from rotating with respect to the arm.

5. An articulated-arm assembly for plumbing fixtures, comprising:

a mounting fixture for fastening the assembly in place, an arm jutting out of the mounting fixture, a pivot joint for joining the arm to the mounting fixture, a brake for locking the arm in place, a ratchet that allows pivoting of the arm in one direction, and, wherein the joint joining the arm to the ratchet is created by the brake.

6. An articulated-arm assembly according to claim 1, wherein the brake is a friction brake.

7. An articulated-arm assembly for plumbing fixtures, comprising:

a mounting fixture for fastening the assembly in place, an arm jutting out of the mounting fixture, a pivot joint for joining the arm to the mounting fixture, a brake for locking the arm in place, a ratchet that allows pivoting of the arm in one direction, wherein the ratchet acts on a sleeve or collar while joined relative to the arm, and, wherein the brake engages a cylindrical inner surface of a collar of the ratchet.

8. An articulated-arm assembly according to claim 7, wherein the brake is arranged coaxial with a collar of the ratchet.

9. An articulated-arm assembly according to claim 1, wherein the brake contains several brake shoes having motions with at least one radial component.

10. An articulated-arm assembly according to claim 9, wherein the brake shoes are actuated by at least one conical component that may be translated in an axial direction.

11. An articulated-arm assembly according to claim 10, comprising a pair of counteroriented conical components whose separation is adjustable.

12. An articulated-arm assembly according to claim 11, wherein the pair of conical components jointly have axial play.

13. An articulated-arm assembly for plumbing fixtures, comprising:

a mounting fixture for fastening the assembly in place, an arm jutting out of the mounting fixture, a pivot joint for joining the arm to the mounting fixture, a brake for locking the arm in place, a ratchet that allows pivoting of the arm in one direction, wherein the brake is spring-loaded.

14. An articulated-arm assembly according to claim 1, wherein a space accommodating at least one of the brake and the ratchet is sealed with respect to the ambient.

15. An articulated-arm assembly according to claim 1, wherein the brake has an adjustable braking force.

16. An articulated-arm assembly according to claim 2, wherein the ratchet acts on an outer surface of the sleeve or collar.

* * * * *